US008761654B2

(12) United States Patent
Kawahara et al.

(10) Patent No.: US 8,761,654 B2
(45) Date of Patent: Jun. 24, 2014

(54) CLEANING DEVICE, PROCESS CARTRIDGE, AND IMAGE FORMING APPARATUS

(75) Inventors: Shinichi Kawahara, Tokyo (JP); Nobuo Kuwabara, Kanagawa (JP); Takeshi Shintani, Kanagawa (JP); Akio Kosuge, Kanagawa (JP); Daisuke Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 13/276,619

(22) Filed: Oct. 19, 2011

(65) Prior Publication Data

US 2012/0134725 A1 May 31, 2012

(30) Foreign Application Priority Data

Nov. 30, 2010 (JP) ..... 2010-266722

(51) Int. Cl.
*G03G 21/00* (2006.01)

(52) U.S. Cl.
USPC ..... 399/346; 399/349

(58) Field of Classification Search
USPC ..... 399/343, 346, 349, 350
See application file for complete search history.

(56) References Cited

U.S. PATENT DOCUMENTS

| | | | | |
|---|---|---|---|---|
| 2007/0134035 | A1* | 6/2007 | Kageyama | 399/346 |
| 2009/0185842 | A1* | 7/2009 | Hatori et al. | 399/346 |

FOREIGN PATENT DOCUMENTS

| | | |
|---|---|---|
| JP | 5-19671 | 1/1993 |
| JP | 11-184340 | 7/1999 |
| JP | 2000-330443 | 11/2000 |
| JP | 2003-140518 | 5/2003 |
| JP | 2004-272019 | 9/2004 |
| JP | 2005-70276 | 3/2005 |
| JP | 2010-117583 | 5/2010 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A cleaning device to remove untransferred toner from a surface of an image carrier rotatable in a predetermined direction. The cleaning device includes a lubricant supply roller contacting the surface of the image carrier to supply a lubricant carried thereon to the surface of the image carrier, a first blade provided upstream from the lubricant supply roller in the direction of rotation of the image carrier, and a second blade provided downstream from the lubricant supply roller. The first blade contacts the surface of the image carrier to level the untransferred toner attaching to the surface of the image carrier to a thin layer. The second blade contacts the surface of the image carrier to level the lubricant supplied to the surface of the image carrier by the lubricant supply roller to a thin layer and to remove the untransferred toner from the surface of the image carrier.

8 Claims, 3 Drawing Sheets

CLEANING DEVICE, PROCESS CARTRIDGE, AND IMAGE FORMING APPARATUS

CROSS-REFERENCE TO RELATED APPLICATIONS

The present patent application is based on and claims priority pursuant to 35 U.S.C. §119 from Japanese Patent Application No. 2010-266722, filed on Nov. 30, 2010, in the Japan Patent Office, which is incorporated by reference herein in its entirety.

BACKGROUND OF THE INVENTION

1. Field of the Invention

Exemplary aspects of the present invention generally relate to a cleaning device that cleans a surface of an image carrier, a process cartridge including the cleaning device, and an image forming apparatus including the process cartridge, and more particularly to a cleaning device including a lubricant supply roller that supplies a lubricant to a surface of an image carrier, a process cartridge including the cleaning device, and an image forming apparatus including the process cartridge.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; a cleaning device removes residual toner from the surface of the photoconductor, and a fixing device applies heat and pressure to the sheet bearing the toner image to fix the toner image onto the sheet. The sheet bearing the fixed toner image is then discharged from the image forming apparatus.

There is known an image forming apparatus using a cleaning device that reliably removes foreign substances such as untransferred toner from an image carrier and a lubricant supply roller that supplies a lubricant to the image carrier to prevent abrasion of the image carrier, a cleaning blade, and so on.

Specifically, the lubricant supply roller supplies a lubricant to a photoconductor serving as the image carrier. The image forming apparatus further includes a cleaning blade provided upstream from the lubricant supply roller in a direction of rotation of the photoconductor to contact a surface of the photoconductor against the direction of rotation of the photoconductor, and a leveling blade provided downstream from the lubricant supply roller to contact the surface of the photoconductor against the direction of rotation of the photoconductor.

In such an image forming apparatus, untransferred toner remaining on the surface of the photoconductor is removed by the cleaning blade, and then the lubricant supply roller supplies the lubricant to the cleaned surface of the photoconductor. Thereafter, the leveling blade levels the lubricant thus supplied to the surface of the photoconductor so that the photoconductor is covered with a layer of lubricant of uniform thickness.

In the related-art image forming apparatus, the leveling blade may chatter, curl, or abrade even in a case in which the lubricant is sufficiently supplied to the surface of the photoconductor by the lubricant supply roller. Specifically, unstable and insufficient supply of the lubricant to the surface of the photoconductor using the lubricant supply roller increases frictional resistance between the leveling blade and the surface of the photoconductor. However, even in a case in which the lubricant is sufficiently supplied to the surface of the photoconductor by the lubricant supply roller, the lubricant thus supplied may be dissolved and deteriorate to have a large viscosity due to high-voltage electrical discharge from the charger that charges the surface of the photoconductor. Consequently, frictional resistance between the leveling blade and the surface of the photoconductor may be increased, possibly causing the leveling blade to chatter, curl, or abrade.

SUMMARY

In view of the foregoing, illustrative embodiments of the present invention provide a novel cleaning device that prevents a blade that contacts an image carrier from chattering, curling, or abrading, a process cartridge including the cleaning device, and an image forming apparatus including the process cartridge.

In one illustrative embodiment, a cleaning device to remove untransferred toner from a surface of an image carrier rotatable in a predetermined direction includes a lubricant supply roller contacting the surface of the image carrier to supply a lubricant carried thereon to the surface of the image carrier, a first blade provided upstream from the lubricant supply roller in the direction of rotation of the image carrier, and a second blade provided downstream from the lubricant supply roller in the direction of rotation of the image carrier. The first blade contacts the surface of the image carrier to level the untransferred toner attaching to the surface of the image carrier to a thin layer, and the second blade contacts the surface of the image carrier to level the lubricant supplied to the surface of the image carrier by the lubricant supply roller to a thin layer and to remove the untransferred toner from the surface of the image carrier.

Another illustrative embodiment provides a process cartridge detachably attachable to an image forming apparatus. The process cartridge includes an image carrier rotatable in a predetermined direction and the cleaning device described above. The cleaning device is formed as a single integrated unit with the image carrier.

Yet another illustrative embodiment provides an image forming apparatus including an image carrier rotatable in a predetermined direction and the cleaning device described above.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
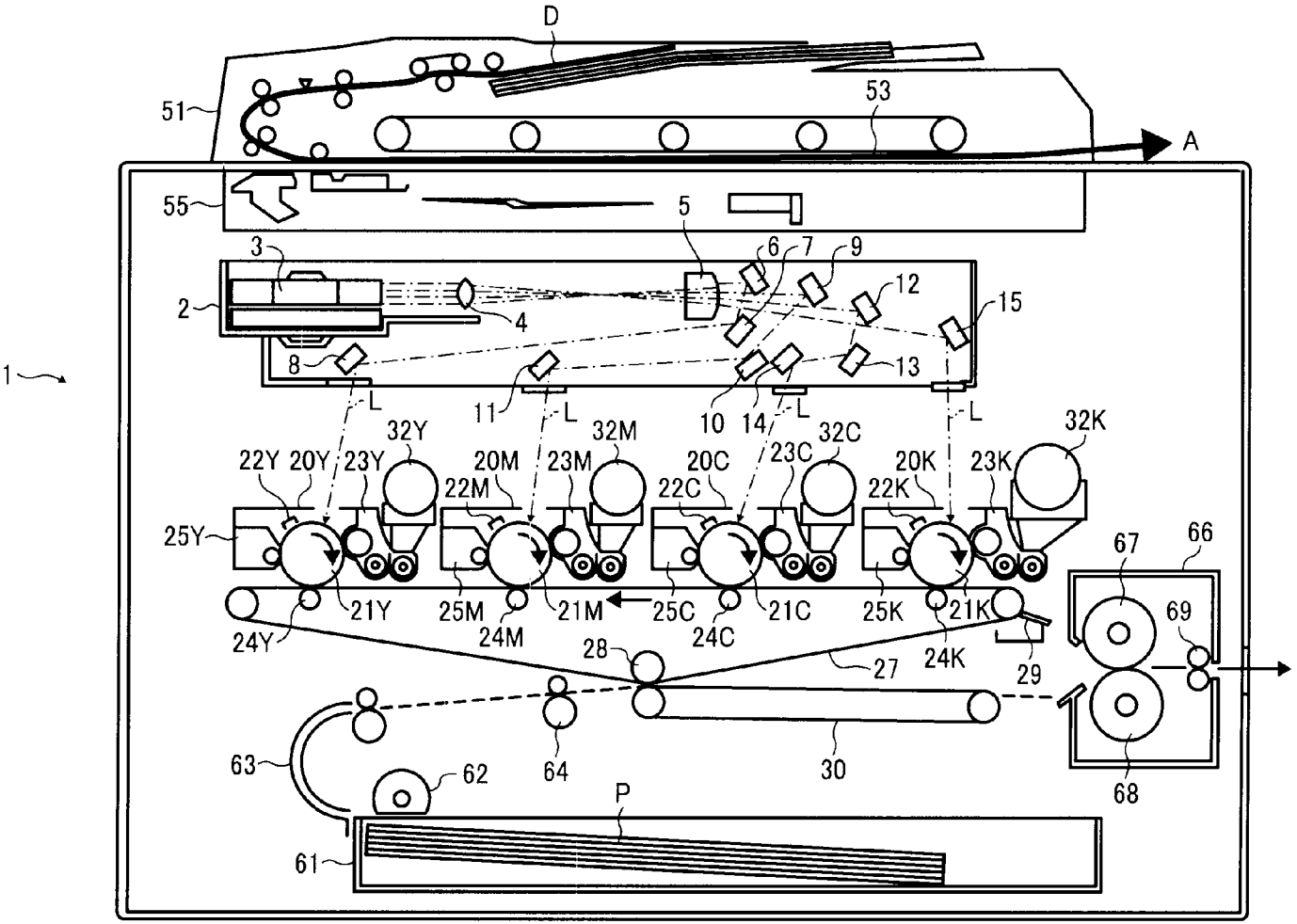
FIG. 1 is a vertical cross-sectional view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a process cartridge is hereinafter defined as a unit in which a photoconductor and at least one of a charger that charges the photoconductor, a developing device that develops a latent image formed on the photoconductor, and a cleaning device that cleans the photoconductor are formed as a single integrated unit, and is detachably attachable to an image forming apparatus.

A configuration and operation of a full-color copier serving as an image forming apparatus 1 according to an illustrative embodiment are described in detail below. FIG. 1 is a vertical cross-sectional view illustrating an example of a configuration of the image forming apparatus 1.

The image forming apparatus 1 includes four process cartridges 20Y, 20M, 20C, and 20K (hereinafter collectively referred to as process cartridges 20) that form a toner image of a specific color, that is, yellow (Y), magenta (M), cyan (C), or black (K). An optical writing unit 2 that emits laser light L based on input image data is provided above the process cartridges 20. The process cartridges 20 respectively includes photoconductors 21Y, 21M, 21C, and 21K (hereinafter collectively referred to as photoconductors 21) each serving as an image carrier, chargers 22Y, 22M, 22C, and 22K (hereinafter collectively referred to as chargers 22) that charge surfaces of the photoconductors 21, developing devices 23Y, 23M, 23C, and 23K (hereinafter collectively referred to as developing devices 23) that develop electrostatic latent images formed on the surfaces of the photoconductors 21, primary transfer rollers 24Y, 24M, 24C, and 24K (hereinafter collectively referred to as primary transfer rollers 24) that primarily transfer toner images formed on the surfaces of the photoconductors 21 onto an intermediate transfer belt 27, and cleaning devices 25Y, 25M, 25C, and 25K (hereinafter collectively referred to as cleaning devices 25) that collect untransferred toner remaining attached to the surfaces of the photoconductors 21 without being transferred onto the intermediate transfer belt 27.

The intermediate transfer belt 27 is provided below the process cartridges 20. The toner images respectively formed on the surfaces of the photoconductors 21 are sequentially transferred onto the intermediate transfer belt 27 and are superimposed one atop the other to form a single full-color toner image. The image forming apparatus 1 further includes a secondary transfer roller 28 that secondarily transfers the full-color toner image thus formed on the intermediate transfer belt 27 onto a recording medium such as a sheet P fed from a sheet feeder 61, a belt cleaning device 29 that collects untransferred toner remaining attached to the intermediate transfer belt 27 without being transferred onto the sheet P, and a conveyance belt 30 that conveys the sheet P having the full-color toner image thereon to a fixing device 66 to fix the full-color toner image onto the sheet P. In addition, toner suppliers 32Y, 32M, 32C, and 32K (hereinafter collectively referred to as toner suppliers 32) that supply toner of the specified colors to the corresponding developing devices 23 and a document conveyance unit 51 that conveys a document D to a document reading unit 55 to read image data of the document D are provided to the image forming apparatus 1.

Here, the photoconductors 21, the chargers 22, and the cleaning devices 25 are formed as a single integrated unit to construct the respective process cartridges 20. The process cartridges 20 are detachably attachable to the image forming apparatus 1 to be replaceable in a predetermined cycle. Similarly, the developing devices 23 are detachably attachable to the image forming apparatus 1 to be replaceable in a predetermined cycle. In the process cartridges 20, a toner image of the specified color, that is, yellow (Y), magenta (M), cyan (C), or black (K), is formed on the surfaces of the photoconductors 21, respectively.

Full-color image formation performed by the image forming apparatus 1 is described in detail below.

The document D set on a document stand is conveyed by conveyance rollers provided to the document conveyance unit 51 in a direction indicated by an arrow A in FIG. 1 to be placed on a contact glass 53 provided to the document reading unit 55. The document reading unit 55 optically reads image data of the document D thus placed on the contact glass 53.

Specifically, the document reading unit 55 scans an image of the document D with light emitted from a lamp. Light reflected from the document D is focused on a color sensor via a group of mirrors and lenses. Color image data of the document D is read by the color sensor separately for color separation components red (R), green (G), and blue (B), and then is converted into electrical signals. In addition, an image processing unit, not shown, performs color conversion, color correction, spatial frequency correction, and so forth on the image data based on the image signals of R, G, and B to obtain color image data of yellow (Y), magenta (M), cyan (C), and black (K).

The image data of yellow (Y), magenta (M), cyan (C), and black (K) is sent to the optical writing unit 2. The optical writing unit 2 directs laser light L onto the surfaces of the photoconductors 21 provided in the corresponding process cartridges 20 based on the image data of the respective colors.

The photoconductors 21 are rotated in a clockwise direction in FIG. 1. The surfaces of the photoconductors 21 are evenly charged by the chargers 22, respectively, to a charging electrical potential of about −700 V. The charged surfaces of the photoconductors 21 reach a position onto which the laser light L of the specified color is directed from the optical writing unit 2, respectively. At that time, the laser light L each corresponding to the image signal of the specified color is emitted from a light source of the optical writing unit 2. The laser light L thus emitted enters a polygon mirror 3, and then is reflected from the polygon mirror 3 and passes through lenses 4 and 5. Thereafter, the laser light L follows optical paths for each color component of yellow (Y), magenta (M), cyan (C), or black (K), respectively.

Specifically, the laser light L corresponding to the color component of yellow (Y) is reflected from mirrors 6, 7, and 8, and then is directed onto the surface of the photoconductor 21Y. At this time, the laser light L corresponding to the color component of yellow (Y) scans in a direction of a rotary shaft of the photoconductor 21Y, that is, a main scanning direction, using the polygon mirror 3 rotated at high speed. Accordingly, an electrostatic latent image of yellow (Y) is formed on the charged surface of the photoconductor 21Y.

Similarly, the laser light L corresponding to the color component of magenta (M) is reflected from mirrors 9, 10, and 11, and then is directed onto the surface of the photoconductor 21M. Thus, the electrostatic latent image of magenta (M) is formed on the charged surface of the photoconductor 21M. The laser light L corresponding to the color component of cyan (C) is reflected from mirrors 12, 13, and 14, and then is directed onto the surface of the photoconductor 21C. Thus, the electrostatic latent image of cyan (C) is formed on the charged surface of the photoconductor 21C. The laser light L corresponding to the color component of black (K) is reflected from a mirror 15, and then is directed onto the surface of the photoconductor 21K. Thus, the electrostatic latent image of black (K) is formed on the charged surface of the photoconductor 21K. It is to be noted that each of the surfaces of the photoconductors 21 has an electrical potential of about −120 V after the laser light L is directed thereto.

The electrostatic latent images thus formed on the surfaces of the photoconductors 21 reach the developing devices 23, respectively, as the photoconductors 21 rotate. The developing devices 23 supply toner of the specified colors to the surfaces of the photoconductors 21 to develop the electrostatic latent images with the toner, respectively. Accordingly, toner images of the specified colors are formed on the surfaces of the photoconductors 21, respectively.

Figure 2:
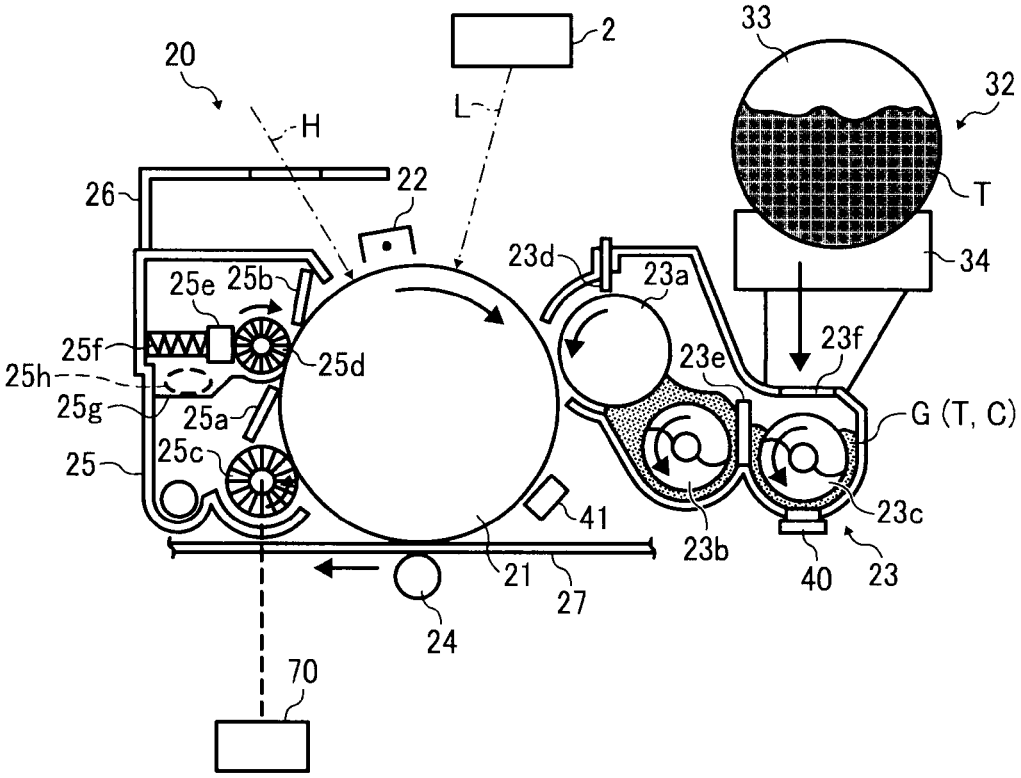
FIG. 2 is a vertical cross-sectional view illustrating an example of a configuration of an image forming unit provided to the image forming apparatus illustrated in FIG. 1.

The toner images thus formed on the surfaces of the photoconductors 21 respectively pass photosensors 41 shown in FIG. 2 as the photoconductors 21 rotate and are conveyed to primary transfer positions where the photoconductors 21 face the intermediate transfer belt 27. At the primary transfer positions, the primary transfer rollers 24 are provided to contact an inner circumferential surface of the intermediate transfer belt 27. The primary transfer rollers 24 primarily transfer the toner images from the surfaces of the photoconductors 21 onto the intermediate transfer belt 27. As a result, the toner images are sequentially superimposed one atop the other to form a full-color toner image on the intermediate transfer belt 27.

The surfaces of the photoconductors 21 from which the toner images are primarily transferred onto the intermediate transfer belt 27 reach the cleaning devices 25, respectively, as the photoconductors 21 further rotate. The cleaning devices 25 remove extraneous substances such as untransferred toner remaining attached to the photoconductors 21 without being transferred onto the intermediate transfer belt 27 from the surfaces of the photoconductors 21, respectively. Thereafter, the surfaces of the photoconductors 21 are neutralized by neutralizing devices, not shown, to complete one image formation sequence performed by the photoconductors 21.

Meanwhile, the intermediate transfer belt 27 bearing the full-color toner image is rotated in a counterclockwise direction in FIG. 1 so that the full-color toner image reaches the secondary transfer roller 28. The secondary transfer roller 28 secondarily transfers the full-color toner image from the intermediate transfer belt 27 onto the sheet P. Thereafter, a portion of the intermediate transfer belt 27 from which the full-color toner image is secondarily transferred onto the sheet P reaches the belt cleaning device 29. The belt cleaning device 29 collects untransferred toner remaining attached to the intermediate transfer belt 27 without being transferred onto the sheet P to complete one transfer sequence performed by the intermediate transfer belt 27.

It is to be noted that the sheet P is conveyed to the secondary transfer roller 28 from the sheet feeder 61 via a conveyance guide 63, a pair of registration rollers 64, and so on. Specifically, the sheet P stored in the sheet feeder 61 is fed by a sheet feed roller 62, and is conveyed to the pair of registration rollers 64 via the conveyance guide 63. The sheet P is then conveyed to the secondary transfer roller 28 by the pair of registration rollers 64 in synchronization with the full-color toner image formed on the intermediate transfer belt 27 so that the full-color toner image is secondarily transferred onto the sheet P by the secondary transfer roller 28.

The sheet P having the full-color toner image thereon is then conveyed to the fixing device 66 by the conveyance belt 30. In the fixing device 66, the full-color toner image is fixed onto the sheet P by a heat roller 67 and a pressing roller 68, between which both the sheet P passes. Thereafter, the sheet P having the fixed full-color toner image thereon is discharged from the image forming apparatus 1 by a discharge roller 69, completing the image formation sequence.

A description is now given of image forming units provided in the image forming apparatus 1 with reference to FIG. 2. FIG. 2 is a vertical cross-sectional view illustrating an example of a configuration of one of the image forming units provided to the image forming apparatus 1. It is to be noted that each of the four image forming units provided to the image forming apparatus 1 has the same basic configuration, differing only in the color of toner used. Therefore, only one of the image forming units is shown as a representative example without the suffixes Y, M, C, and K each representing the color of toner in FIG. 2 and subsequent drawings.

As illustrated in FIG. 2, in each of the process cartridges 20, the photoconductor 21, the charger 22, and the cleaning device 25 also serving as a lubricant supplier are integrally accommodated within a casing 26.

Each of the photoconductors 21 is a negatively charged organic photoreceptor in which a photosensitive layer is provided on a drum-type conductive support. Specifically, an insulative undercoat layer, an electrical charge generation layer serving as the photosensitive layer, an electrical charge transport layer, and a protection layer serving as a top layer are sequentially laminated on the conductive support serving as a base layer to construct each of the photoconductors 21.

A corona wire is extended at the center of a U-shaped metal plate in each of the chargers 22. A predetermined voltage is supplied from a power source, not shown, to the corona wire of each of the chargers 22 so that the chargers 22 evenly charge the surfaces of the respective photoconductors 21.

Alternatively, a charging roller including a conductive metal core coated with an elastic layer of intermediate electrical resistance may be used as the chargers 22. Further alternatively, a metal grid panel may be provided on an opposing surface of each of the chargers 22 that faces the corresponding photoconductor 21.

Each of the developing devices 23 includes a developing roller 23*a* provided opposite the corresponding photoconductor 21, a first conveyance screw 23*b* provided opposite the developing roller 23*a*, a second conveyance screw 23*c* provided opposite the first conveyance screw 23*b* with a wall 23*e* interposed therebetween, and a doctor blade 23*d* provided opposite the developing roller 23*a*, away from the first conveyance screw 23*b*. The developing roller 23*a* is constructed of a magnet fixed therewithin to form magnetic poles around a surface of the developing roller 23*a* and a sleeve rotated around the magnet. Multiple magnetic poles are formed on the developing roller 23*a* by the magnet so that the developing roller 23*a* carries a developer G thereon.

The developer G, which in this case is a two-component developer including a carrier C and toner T, is stored in each of the developing devices 23. In order to achieve higher image quality, smaller-diameter, round-particle toner having an even particle diameter produced by a polymerization method is used as the toner T in the image forming apparatus 1.

Specifically, the toner T has a circularity of not less than 0.92. A flow-type particle image analyzer FPIA-2000 manufactured by Sysmex Corporation was used to measure an average circularity of the toner T. Measurements were performed in the following manner. From 0.1 ml to 0.5 ml of surfactant (preferably alkylbenzene sulfonate) serving as a dispersant and from 0.1 g to 0.5 g of a sample, that is, toner, were added to from 100 ml to 150 ml of water, from which impurities were removed in advance. Subsequently, the mixture in which the toner is dispersed was dispersed using an ultrasonic dispersing machine for from 1 to 3 minutes to prepare a sample solution including 3,000 to 10,000 particles/μl. The sample solution thus prepared was then set to the flow-type particle image analyzer FPIA-2000 to measure the shape and particle size distribution of the toner T.

The toner T having higher circularity with a shape factor SF-1 of from 100 to 180 and a shape factor SF-2 of from 100 to 180 is used in the image forming apparatus 1. A volume average particle diameter (Dv) of the toner T is in a range between 3 μm and 8 μm, and a ratio (Dv/Dn) of the volume average particle diameter (Dv) to a number average particle diameter (Dn) of the toner T is in a range between 1.05 and 1.40. The toner T has a substantially spherical shape with a long axis r1, a short axis r2, and a thickness r3 that satisfy a relationship of r1≥r2≥r3. It is preferable that a ratio (r2/r1) of the short axis r2 to the long axis r1 be in a range between 0.5 and 1.0, and a ratio (r3/r2) of the thickness r3 to the short axis r2 be in a range between 0.7 and 1.0.

It is to be noted that the above-described method for measuring the characteristics of the toner T is disclosed in JP-2010-117583-A and JP-2005-070276-A.

The toner T preferably used for image formation performed by the image forming apparatus 1 is obtained by a cross-linking reaction and/or an elongation reaction of a toner constituent liquid in an aqueous solvent under presence of resin particles. Here, the toner constituent liquid is prepared by dispersing a polyester prepolymer including a functional group having at least a nitrogen atom, a polyester, a colorant, and a releasing agent in an organic solvent.

Returning to FIG. 2, each of the cleaning devices 25 includes a first blade 25*a*, a second blade 25*b*, a brush roller 25*c*, a lubricant supply roller 25*d*, a solid lubricant 25*e*, a compression spring 25*f*, and a partition 25*g*. As described in detail later, each of the cleaning devices 25 functions both as a cleaning device that removes and collects extraneous substances such as the untransferred toner from the surface of each of the photoconductors 21 and as a lubricant supplier that supplies the solid lubricant 25*e* to the surface of each of the photoconductors 21.

In addition to the untransferred toner, examples of the extraneous substances include paper dust from the sheet P, corona products generated on the surfaces of the photoconductors 21 during electrical discharge of the chargers 22, additives added to the toner T, and other substances remaining attached to the surfaces of the photoconductors 21.

The image formation sequence performed by the image forming apparatus 1 is described further in detail below with reference to FIG. 2.

The developing roller 23*a* is rotated in a counterclockwise direction in FIG. 2. The first and second conveyance screws 23*b* and 23*c*, each rotated in the counterclockwise direction, agitate the developer G stored in each of the developing devices 23 and mix the developer G with the toner T supplied from the corresponding toner suppliers 32 via a toner supply opening 23*f* provided to each of the developing devices 23. Accordingly, the developer G is circulated in a longitudinal direction of the developing devices 23, that is, a direction perpendicular to the plane of the sheet of paper on which FIG. 2 is drawn.

The frictionally charged toner T attaches to the carrier C to be carried along together with the carrier C by the developing roller 23*a*. The developer G carried by the developing roller 23*a* reaches the doctor blade 23*d* as the developing roller 23*a* rotates. The doctor blade 23*d* appropriately adjusts an amount of the developer G carried by the developing roller 23*a*, and the developer G is further conveyed to a developing range positioned opposite the corresponding photoconductors 21.

At the developing range, the toner T included in the developer G attaches to the electrostatic latent image formed on each of the surfaces of the photoconductors 21. Specifically, an electrical field formed by a potential difference between the electrostatic latent image and a voltage of about −470 V supplied to the developing roller 23*a* causes the toner T to attach to the electrostatic latent image.

Much of the toner T attaching to the surface of each of the photoconductors 21 is primarily transferred onto the intermediate transfer belt 27 by the primary transfer rollers 24. Untransferred toner remaining attached to the photoconductors 21 without being transferred onto the intermediate transfer belt 27 is removed and collected by the cleaning devices 25, respectively. Thereafter, the surfaces of the photoconductors 21 are neutralized with light H to complete the image formation sequence.

Each of the toner suppliers 32 provided to the image forming apparatus 1 is constructed of a replaceable toner bottle 33 and a toner hopper 34 that holds and rotatively drives the toner bottle 33 as well as supplies a new toner T to the corresponding developing devices 23. The toner bottle 33 stores the new toner T of the specified color and has a spiral protrusion on an inner surface thereof.

It is to be noted that the new toner T is appropriately supplied from the toner bottle 33 into each of the developing devices 23 through the toner supply opening 23*f* in accordance with consumption of the toner T stored in the corresponding developing devices 23. The reflective-type photosensor 41 provided opposite each of the photoconductors 21 and a magnetic sensor 40 provided below the second conveyance screw 23*c* directly or indirectly detect consumption of the toner T in each of the developing devices 23.

In the present illustrative embodiment, a proportion of toner T to developer G, that is, toner density, is controlled to have a predetermined value. Specifically, the new toner T is appropriately supplied from the toner suppliers 32 to the corresponding developing devices 23, respectively, via the toner supply opening 23*f* provided to each of the developing devices 23 such that detected values output from the magnetic sensor 40 and the reflective-type photosensor 41 have the predetermined value.

Figure 3:
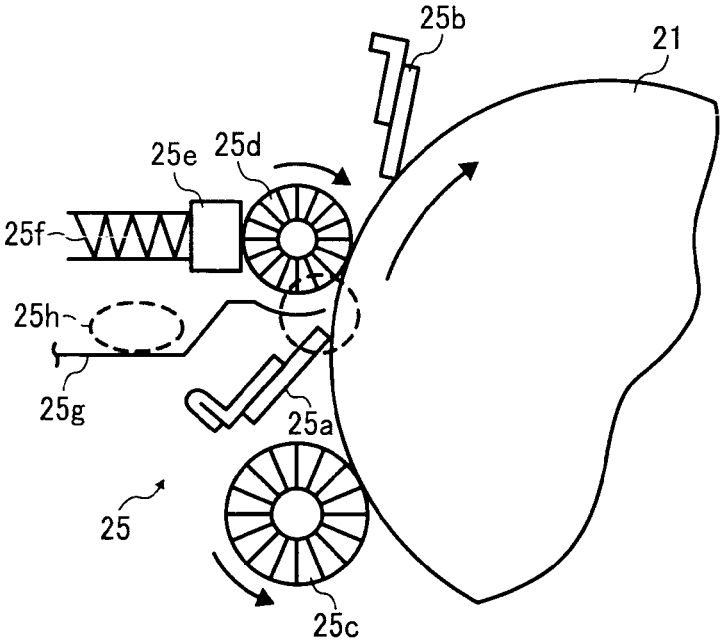
FIG. 3 is an enlarged schematic view illustrating an example of a configuration of a cleaning device provided to the image forming apparatus.

A description is now given of an example of a configuration and operation of the cleaning devices 25. FIG. 3 is an enlarged schematic view illustrating an example of a configuration of the cleaning devices 25.

As described previously with reference to FIG. 2, each of the cleaning devices 25 includes the first blade 25*a*, the second blade 25*b*, the brush roller 25*c*, the lubricant supply roller 25*d*, the solid lubricant 25*e*, the compression spring 25*f*, and the partition 25*g*.

The lubricant supply roller 25*d* is constructed of a metal core and bristles provided to an outer circumference of the metal core, and is rotated in a clockwise direction in FIG. 3 while contacting the surface of the corresponding photoconductor 21. Accordingly, the lubricant supply roller 25*d* scrapes off the solid lubricant 25*e* and supplies the lubricant to the surface of the corresponding photoconductor 21.

Bristles each having a length in a range between 0.2 mm and 20 mm, preferably between 0.5 mm and 10 mm, are migrated onto a ground fabric, and the ground fabric having the migrated bristles is spirally wound around the metal core to construct the lubricant supply roller 25*d*. If too long, the bristles are bent in a predetermined direction due to repeated sliding against the photoconductors 21 over time, thereby degrading the ability of the lubricant supply roller 25*d* to scrape off the solid lubricant 25*e* and supply the lubricant to the surface of the photoconductor 21. By contrast, if too short, the bristles do not have a sufficient force to physically contact both the solid lubricant 25*e* and the photoconductor 21. Thus, it is preferable that each of the bristles of the lubricant supply roller 25*d* have the preferable length described above.

Specific examples of the material used for the bristles of the lubricant supply roller 25*d* include, but are not limited to, resin fibers such as nylon fibers, rayon fibers, acrylic fibers, vinylon fibers, polyester fibers, vinyl chloride fibers, fluorocarbon fibers, and polyamide fibers. Alternatively, conductive fibers in which a conductivity imparting agent such as carbon is mixed may be used for the bristles of the lubricant supply roller 25*d*, as needed. It is preferable that the lubricant supply roller 25*d* have a density of from 10,000 to 500,000 bristles per square inch and a resistivity of from $10^2$ Ω·cm to $10^8$ Ω·cm.

In the present illustrative embodiment, the lubricant supply roller 25*d* has bristles each having a length of 3 mm, a density of 100,000 bristles per square inch, and a resistivity of $10^5$ Ω·cm.

The lubricant supply roller 25*d* is rotated in a clockwise direction in FIG. 3 and contacts the surface of the photoconductor 21 against the direction of rotation of the photoconductor 21, which is also rotated in the clockwise direction. Specifically, the lubricant supply roller 25*d* is rotated in a direction opposite the direction of rotation of the photoconductor 21 at a contact position where the lubricant supply roller 25*d* and the surface of the photoconductor 21 contact each other.

The lubricant supply roller 25*d* is provided to contact both the solid lubricant 25*e* and the surface of the photoconductor 21, and scrapes off the solid lubricant 25*e* while rotating to supply the lubricant to the surface of the photoconductor 21. As illustrated in FIG. 2, the compression spring 25*f* presses the solid lubricant 25*e* against the lubricant supply roller 25*d* to cause the solid lubricant 25*e* to evenly contact the lubricant supply roller 25*d*.

Because the lubricant supply roller 25*d* is rotated against the direction of rotation of the photoconductor 21 at the contact position with the surface of the photoconductor 21 as described above, a part of the lubricant scraped off from the solid lubricant 25*e* and carried by the lubricant supply roller 25*d* is flicked off from the lubricant supply roller 25*d* immediately after passing thorough the contact position due to a restorative force of the bristles, and attaches to the surface of the photoconductor 21. Thereafter, the lubricant supply roller 25*d* rubs the surface of the photoconductor 21 with the lubricant thus attaching to the surface of the photoconductor 21 and levels a thickness of the lubricant on the surface of the photoconductor 21.

The solid lubricant 25*e* is formed of zinc stearate. Specifically, a lubricating oil additive including zinc stearate as a main component is dissolved to form the solid lubricant 25*e*. Use of the solid lubricant 25*e* that has sufficient lubricating property and causes fewer side effects even in the event of too much supply is preferable.

Zinc stearate is one common lamellar crystalline powder. Lamellar crystalline powders have a layered structure in which an amphiphilic molecule is self-assembled, and the crystals tend to break up at the interfaces between layers and slide when subjected to a shear force. Therefore, the surface of each of the photoconductors 21 can have a lower friction. Specifically, the shear force is applied to the lamellar crystals so that the surface of each of the photoconductors 21 is evenly and effectively covered with a smaller amount of the lubricant.

Alternatively, other materials belonging to the stearate group, such as barium stearate, iron stearate, nickel stearate, cobalt stearate, copper stearate, strontium stearate, and calcium stearate, may be used for the solid lubricant 25*e*. Further alternatively, materials belonging to the fatty acid group, such as zinc oleate, barium oleate, lead oleate, copper oleate, zink palmitate, barium palmitate, lead palmitate, and copper palmitate, or materials belonging to the caprylic acid group, the linolenic acid group, and co-linolenic acid group, may be used for the solid lubricant 25*e*. Yet further alternatively, waxes such as candelilla wax, carnauba wax, rice wax, haze wax, jojoba wax, bees wax, and lanoline, or fluorocarbon resins such as polytetrafluoroethylene and polychloro-trifluoro-ethylene may be used for the solid lubricant 25*e*. An organic solid lubricant compatible with toner is easily formed from the above-described materials.

The first blade 25*a* is provided upstream from the lubricant supply roller 25*d* in the direction of rotation of the photoconductor 21 to contact the surface of the photoconductor 21. Untransferred toner remaining attached to the surface of the photoconductor 21 after primary transfer of the toner image onto the intermediate transfer belt 27 is leveled to a thin layer by the first blade 25*a*. Specifically, unlike the related-art cleaning blade that removes untransferred toner from the surface of the photoconductor, the first blade 25*a* functions to form a thin layer of untransferred toner on the surface of the photoconductor 21. It is to be noted that an excessive amount of untransferred toner which is removed from the surface of the photoconductor 21 by the first blade 25*a* is collected within the cleaning device 25.

Figure 4A:
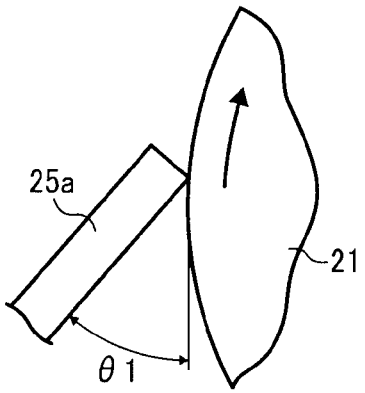
FIGS. 4A and 4B are enlarged partial views illustrating leading edges of first and second blades provided to the cleaning device, respectively.

The first blade 25*a* is formed of an elastomer such as urethane resin elastomer, fluorocarbon resin elastomer, or silicone resin elastomer, and is fixed to a holder formed of a metal plate. The first blade 25*a* is provided to contact the surface of the photoconductor 21 in a trailing direction along the direction of rotation of the photoconductor 21. As illustrated in FIG. 4A, the first blade 25*a* contacts the surface of the photoconductor 21 in the trailing direction such that an angle of contact θ1 formed between an upstream tangential line passing through a contact position where the first blade 25*a* contacts the surface of the photoconductor 21 and an opposing surface of the first blade 25*a* that faces the surface of the photoconductor 21 is less than 90°(0°<θ1<90°). In the present illustrative embodiment, the angle of contact θ1 is set in a range between 10° and 30°, and the first blade 25*a* is pressed against the surface of the photoconductor 21 at a pressure of from 5 N/m to 30 N/m.

Thus, the first blade 25*a* fixed to the holder elastically contacts the surface of the photoconductor 21 at the appropriate angle of contact and pressure described above. As a result, an appropriate amount of untransferred toner on the surface of the photoconductor 21 passes through the first blade 25*a* and evenly remains attached to the surface of the photoconductor 21 in a thin layer. The thin layer of untransferred toner on the surface of the photoconductor 21 is then conveyed to the second blade 25*b* provided downstream from the first blade 25*a*.

Returning to FIGS. 2 and 3, the second blade 25*b* is provided downstream from the lubricant supply roller 25*d* to contact the surface of the photoconductor 21. The lubricant supplied to the surface of the photoconductor 21 by the lubricant supply roller 25*d* is leveled to a thin layer by the second blade 25*b*. Further, the untransferred toner remaining attached to the surface of the photoconductor 21 is fully removed by the second blade 25*b*. Thus, in addition to the function of the related-art leveling blade that levels the lubricant supplied to the surface of the photoconductor, the second blade 25*b* also has the function of removing the untransferred toner, which is leveled to a thin layer by the first blade 25*a* in advance, from the surface of the photoconductor 21. It is to be noted that the untransferred toner removed from the surface of the photoconductor 21 by the second blade 25*b* is collected within the cleaning device 25.

Figure 4B:
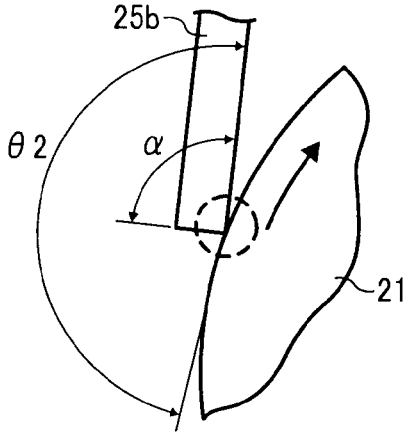

The second blade 25*b* is formed of an elastomer such as urethane resin elastomer, fluorocarbon resin elastomer, or silicone resin elastomer, and is fixed to a holder formed of a metal plate. The second blade 25*b* is provided to contact the surface of the photoconductor 21 in a direction counter to the direction of rotation of the photoconductor 21. As illustrated in FIG. 4B, the second blade 25*b* contacts the surface of the photoconductor 21 in the counter direction such that an angle of contact $\theta_2$ formed between an upstream tangential line passing through a contact position where the second blade 25*b* contacts the surface of the photoconductor 21 and an opposing surface of the second blade 25*b* that faces the surface of the photoconductor 21 is greater than 90° and less than 180°(90°<θ2<180°). In the present illustrative embodiment, the angle of contact θ2 is set in a range between 100° and 120°, and the second blade 25*b* is pressed against the surface of the photoconductor 21 at a pressure of from 5 N/m to 30 N/m.

Thus, the second blade 25*b* optimally contacts the surface of the photoconductor 21 to remove the untransferred toner from the surface of the photoconductor 21 using a difference in physical property between the untransferred toner and the lubricant, such as particle diameter and frictional resistance, and to form a thin layer of the lubricant on the surface of the photoconductor 21. As a result, the second blade 25*b* levels the lubricant on the surface of the photoconductor 21 to a thin layer to sufficiently bring out the lubricating property of the lubricant and to reliably remove the untransferred toner from the surface of the photoconductor 21.

An appropriate amount of untransferred toner, which is leveled to a thin layer by the first blade 25*a*, is conveyed to a leading edge of the second blade 25*b* encompassed by a broken-line circle in FIG. 4B to function as a second lubricant to prevent an increase in a frictional resistance between the second blade 25*b* and the surface of the photoconductor 21. It is to be noted that the second lubricant, that is, the untransferred toner, does not deteriorate even under high-voltage electrical discharge from the charger 22. Therefore, even in a case in which the lubricant supplied to the surface of the photoconductor 21 itself is dissolved and deteriorates due to high-voltage electrical discharge from the charger 22, occurrence of chatter vibration, curling, or abrasion of the second blade 25*b* can be considerably reduced by the untransferred toner that functions as the second lubricant.

It is to be noted that the first blade 25*a* contacts the surface of the photoconductor 21 in favorable conditions so that the first blade 25*a* does not chatter, curl, or abrade.

In a case in which the first blade 25*a* is not provided to the cleaning device 25, a larger amount of untransferred toner is conveyed to the lubricant supply roller 25*d*. Consequently, such a larger amount of untransferred toner is carried by the lubricant supply roller 25*d* and reduces an amount of lubricant carried by the lubricant supply roller 25*d*, thereby reducing an amount of lubricant supplied to the surface of the photoconductor 21. In the present illustrative embodiment, the first blade 25*a* is provided to cause a minimum necessary amount of untransferred toner to remain attaching to the surface of the photoconductor 21. Accordingly, an appropriate and sufficient amount of lubricant is supplied to the surface of the photoconductor 21 by the lubricant supply roller 25*d*, and occurrence of chatter vibration, curling, or abrasion of the second blade 25*b* can be efficiently reduced.

The second blade 25*b* is provided such that the leading edge of the second blade 25*b* contacting the surface of the photoconductor 21 substantially forms a right angle in cross-section as indicated by an angle α in FIG. 4B. Thus, the untransferred toner can be reliably removed from the surface of the photoconductors 21 by the second blade 25*b*.

It is to be noted that the holder to which the second blade 25*b* is fixed is positioned relative to the casing 26 of the cleaning device 25 with screws or the like. The above-described method for holding the second blade 25*b* (hereinafter referred to as stationary holding method) can accurately set the angle of contact θ2 of the second blade 25*b* relative to the surface of the photoconductor 21.

Figure 5:
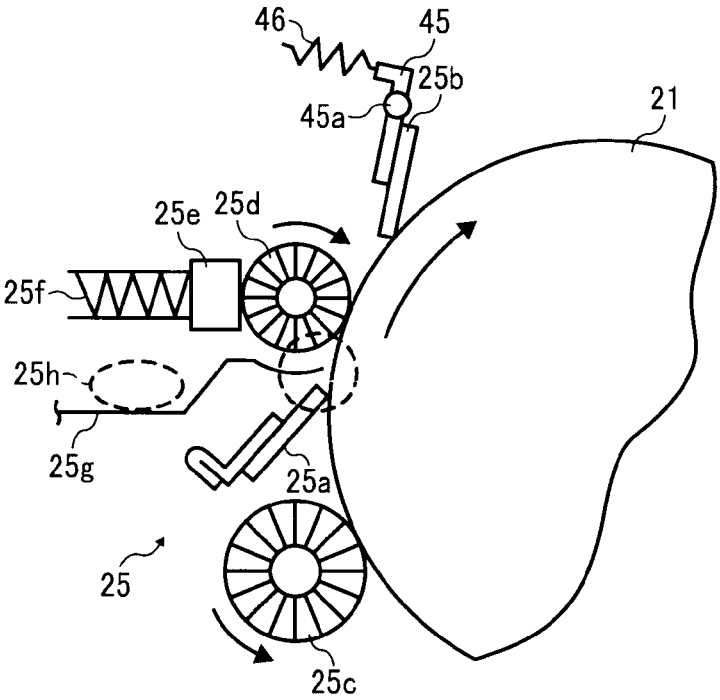
FIG. 5 is an enlarged schematic view illustrating another example of a configuration of a cleaning device provided to the image forming apparatus.

Alternatively, as illustrated in FIG. 5, a holder 45 to which the second blade 25*b* is fixed is held rotatably around a support shaft 45*a* by the casing 26 of the cleaning device 25 to press the second blade 25*b* against the surface of the photoconductor 21 by a force of an extension spring 46 connected to the holder 45. Such a method for holding the second blade 25*b* illustrated in FIG. 5 (hereinafter referred to as constant load method) can accurately set the contact pressure of the second blade 25*b* against the surface of the photoconductor 21.

Understanding the characteristics of each of the above-described methods for holding the second blade 25*b*, it is preferable that one of the holding methods be appropriately selected to control the functions of the second blade 25*b* that evenly levels the lubricant to a thin layer and removes the untransferred toner from the surface of the photoconductor 21.

Returning to FIGS. 2 and 3, the brush roller 25*c* is provided upstream from the first blade 25*a*. Bristles each slidably contacting the surface of the photoconductor 21 are provided to an outer circumference of a metal core of the brush roller 25*c* in a manner similar to the lubricant supply roller 25*d*. The brush roller 25*c* is rotated in the counterclockwise direction while contacting the surface of the corresponding photoconductor 21. A part of extraneous substances attaching to the surface of the photoconductor 21 such as untransferred toner is scraped off by the brush roller 25*c* and is collected within the cleaning device 25.

By contrast, untransferred toner remain attaching to the surface of the photoconductor 21 is leveled by the bristles of the brush roller 25*c* when passing through the brush roller 25*c* and is evenly distributed in a width direction of the photoconductor 21, that is, a direction passing through the plane of the sheet of paper on which FIG. 2 or 3 is drawn. The untransferred toner thus leveled in the width direction by the brush roller 25*c* is further evenly leveled to a thin layer by the first blade 25*a*, and the resultant untransferred toner is conveyed to the second blade 25*d*. As a result, occurrence of chatter vibration, curling, or abrasion of the second blade 25*d* can be reliably prevented as described above. Thus, the untransferred toner is prevented from being unevenly conveyed to a part of the second blade 25*d* in the width direction.

As illustrated in FIG. 2, the cleaning device 25 further includes a swing mechanism 70 that swings the brush roller 25*c* axially along the surface of the photoconductor 21, perpendicular to the direction of rotation of the photoconductor 21. As a result, the brush roller 25*c* further evenly levels the untransferred toner laterally, thereby reliably preventing occurrence of chatter vibration, curling, or abrasion of the second blade 25*d*.

The partition 25*g* isolates the lubricant supply roller 25*d* and the first blade 25*a* from each other. Even when the untransferred toner passing through the first blade 25*a* is flicked off from the surface of the photoconductor 21 by the lubricant supply roller 25*d*, the untransferred toner thus flicked is accumulated in a storage 25*h* in the partition 25*g*. Accordingly, the untransferred toner flicked off from the surface of the photoconductor 21 is prevented from accumulating between the lubricant supply roller 25*d* and the first blade 25*a*.

Thus, in the cleaning device 25 according to the present illustrative embodiment, the first blade 25*a* that levels untransferred toner attaching to the surface of the photoconductor 21 is provided upstream from the lubricant supply roller 25*d*, and the second blade 25*b* that levels the lubricant supplied to the surface of the photoconductor 21 and removes the untransferred toner from the surface of the photoconductor 21 is provided downstream from the lubricant supply roller 25*d*. As a result, occurrence of chatter vibration, curling, or abrasion of the first and second blades 25*a* and 25*b* each contacting the surface of the photoconductor 21 can be reduced.

It is to be noted that, in the present illustrative embodiment, the cleaning device 25, the photoconductor 21, and the charger 22 are formed as a single integrated unit to construct the process cartridge 20, thereby making each of the image forming units more compact and facilitating maintenance of the image forming units.

Alternatively, the cleaning device 25 may be separately provided from the process cartridge 20, and be replaceably provided to the image forming apparatus 1 as a separate unit. In such a case, effects similar to those achieved by the present illustrative embodiment can be achieved.

In addition, the present illustrative embodiment is applicable to the image forming apparatus 1 including the developing devices 23 that use a single-component developer as well as two-component developer. Further, the present illustrative embodiment is applicable not only to the cleaning devices 25 that clean the surfaces of the photoconductors 21 each serving as an image carrier but also to cleaning devices that clean photoconductive belts each also serving an image carrier or the belt cleaning device 29 that cleans the intermediate transfer belt 27 serving as an image carrier.

Although a brush roller is used as the lubricant supply roller 25*d* that contacts the surface of the photoconductor 21 to supply the lubricant to the surface of the photoconductor 21, the configuration of the lubricant supply roller 25*d* is not limited thereto. Alternatively, an elastic roller having a rough surface capable of scraping off the solid lubricant 25*e* may be used as the lubricant supply roller 25*d*. In such a case, effects similar to those achieved by the present illustrative embodiment can be achieved.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cleaning device to remove untransferred toner from a surface of an image carrier rotatable in a predetermined direction, the cleaning device comprising:

a lubricant supply roller contacting the surface of the image carrier to supply a lubricant carried thereon to the surface of the image carrier;

a first blade provided upstream from the lubricant supply roller in the direction of rotation of the image carrier, the first blade contacting the surface of the image carrier to level the untransferred toner attaching to the surface of the image carrier to a thin layer; and a second blade provided downstream from the lubricant supply roller in the direction of rotation of the image carrier, the second blade contacting the surface of the image carrier to level the lubricant supplied to the surface of the image carrier by the lubricant supply roller to a thin layer and to remove the untransferred toner from the surface of the image carrier, wherein the first blade contacts the surface of the image carrier in a trailing direction along the direction of rotation of the image carrier; and wherein the second blade contacts the surface of the image carrier in a direction counter to the direction of rotation of the image carrier.

2. The cleaning device according to claim 1, wherein an angle of contact θ1 at which the first blade contacts the surface of the image carrier formed between an upstream tangential line passing through a contact position where the first blade contacts the surface of the image carrier and an opposing surface of the first blade that faces the surface of the image carrier is less than 90°.

3. The cleaning device according to claim 1, wherein an angle of contact θ2 at which the second blade contacts the surface of the image carrier formed between an upstream tangential line passing through a contact position where the second blade contacts the surface of the image carrier and an opposing surface of the second blade that faces the surface of the image carrier is greater than 90° and less than 180°.

4. The cleaning device according to claim 1, further comprising a brush roller having bristles to contact the surface of the image carrier and provided upstream from the first blade in the direction of rotation of the image carrier, the brush roller being swingable axially along the surface of the image carrier perpendicular to the direction of rotation of the image carrier.

5. The cleaning device according to claim 1, further comprising a partition provided between the lubricant supply roller and the first blade to isolate the lubricant supply roller and the first blade from each other, wherein the lubricant supply roller is rotated in a direction opposite the direction of rotation of the image carrier at a contact position where the lubricant supply roller contacts the surface of the image carrier.

6. The cleaning device according to claim 1, wherein a leading edge of the second blade contacting the surface of the image carrier forms a right angle in cross-section.

7. A process cartridge detachably attachable to an image forming apparatus, comprising:

an image carrier rotatable in a predetermined direction; and a cleaning device formed as a single integrated unit with the image carrier to remove untransferred toner from a surface of the image carrier, the cleaning device comprising:

a lubricant supply roller contacting the surface of the image carrier to supply a lubricant carried thereon to the surface of the image carrier;

a first blade provided upstream from the lubricant supply roller in the direction of rotation of the image carrier, the first blade contacting the surface of the image carrier to level the untransferred toner attaching to the surface of the image carrier to a thin layer; and a second blade provided downstream from the lubricant supply roller in the direction of rotation of the image carrier, the second blade contacting the surface of the image carrier to level the lubricant supplied to the surface of the image carrier by the lubricant supply roller to a thin layer and to remove the untransferred toner from the surface of the image carrier, wherein the first blade contacts the surface of the image carrier in a trailing direction along the direction of rotation of the image carrier; and wherein the second blade contacts the surface of the image carrier in a direction counter to the direction of rotation of the image carrier.

8. An image forming apparatus comprising:

an image carrier rotatable in a predetermined direction; and a cleaning device to remove untransferred toner from a surface of the image carrier, the cleaning device comprising:

a lubricant supply roller contacting the surface of the image carrier to supply a lubricant carried thereon to the surface of the image carrier;

a first blade provided upstream from the lubricant supply roller in the direction of rotation of the image carrier, the first blade contacting the surface of the image carrier to level the untransferred toner attaching to the surface of the image carrier to a thin layer; and a second blade provided downstream from the lubricant supply roller in the direction of rotation of the image carrier, the second blade contacting the surface of the image carrier to level the lubricant supplied to the surface of the image carrier by the lubricant supply roller to a thin layer and to remove the untransferred toner from the surface of the image carrier, wherein the first blade contacts the surface of the image carrier in a trailing direction along the direction of rotation of the image carrier; and wherein the second blade contacts the surface of the image carrier in a direction counter to the direction of rotation of the image carrier.

* * * * *